US006851225B1

(12) United States Patent
Haar et al.

(10) Patent No.: US 6,851,225 B1
(45) Date of Patent: Feb. 8, 2005

(54) DEVICE FOR EQUALIZING CHANGES IN LEVEL BETWEEN A GROUND AREA SURFACE AND A FRAME FOR A MANHOLE COVER, AND A METHOD FOR MOUNTING THE DEVICE

(76) Inventors: Egon Haar, Grünhüblgasse 23, Judenburg (AT), A-8750; Ernst Hackenberg, Flurweg 30, Fohnsdorf (AT), A-8753

( * ) Notice: Subject to any disclaimer, the term of this patent is extended or adjusted under 35 U.S.C. 154(b) by 0 days.

(21) Appl. No.: 10/031,558

(22) PCT Filed: Apr. 18, 2000

(86) PCT No.: PCT/AT00/00095

§ 371 (c)(1),
(2), (4) Date: May 28, 2002

(87) PCT Pub. No.: WO00/65159

PCT Pub. Date: Nov. 2, 2000

(30) Foreign Application Priority Data

Apr. 23, 1999 (AT) ..... A 725/99

(51) Int. Cl.[7] ..... E02D 29/14

(52) U.S. Cl. ..... 52/20; 52/19; 404/26; 404/25

(58) Field of Search ..... 52/19, 20, 21; 404/26, 25

(56) References Cited

U.S. PATENT DOCUMENTS

| | | | | | |
|---|---|---|---|---|---|
| 257,743 | A | * | 5/1882 | Murray | 404/25 |
| 3,973,856 | A | * | 8/1976 | Gaglioti | 404/25 |
| 4,038,789 | A | * | 8/1977 | Axgarde et al. | 52/20 |
| 4,466,219 | A | * | 8/1984 | Campolito | 52/20 |
| 4,498,804 | A | * | 2/1985 | Ferns | 404/25 |
| 4,936,703 | A | | 6/1990 | Ferns | |
| 5,044,818 | A | | 9/1991 | Pritchard | |
| 5,299,884 | A | | 4/1994 | Westhoff | |
| 5,451,081 | A | | 9/1995 | Kauknik | |
| 5,597,263 | A | * | 1/1997 | Bravo | 404/26 |
| 5,944,442 | A | * | 8/1999 | Roush et al. | 404/26 |
| 5,966,876 | A | * | 10/1999 | Neathery et al. | 52/20 |
| 6,457,901 | B1 | * | 10/2002 | Sondrup | 404/26 |

FOREIGN PATENT DOCUMENTS

| | | |
|---|---|---|
| AT | 403 492 | 7/1995 |
| CA | 1 270 138 | 11/1982 |
| CA | 1289799 | 9/1987 |
| DE | 29 48 050 | 6/1981 |
| DE | 34 42 178 | 11/1984 |
| DE | 38 21 545 | 3/1989 |
| JP | 09 088109 | 3/1997 |
| WO | 99 53148 | 10/1999 |

* cited by examiner

*Primary Examiner*—Carl D. Friedman
*Assistant Examiner*—Chi Q Nguyen
(74) *Attorney, Agent, or Firm*—Collard & Roe, PC.

(57) ABSTRACT

A device for equalizing changes in level between a ground area surface extending over a ground structure and a frame for closure of an installation projecting into a ground structure therebelow, comprises a plate-shaped dragging body connected to the closure frame and projecting horizontally into the ground structure below a carrying layer thereof so as to transfer the change in level to the closure frame, the plate-shaped dragging body being a separate structural element which supports the closure frame on an upper side thereof.

19 Claims, 10 Drawing Sheets

DEVICE FOR EQUALIZING CHANGES IN LEVEL BETWEEN A GROUND AREA SURFACE AND A FRAME FOR A MANHOLE COVER, AND A METHOD FOR MOUNTING THE DEVICE

CROSS REFERENCE TO RELATED APPLICATIONS

Applications claim priority under 35 U.S.C. §119 of Austrian Application No. A 725/99, filed on Apr. 23, 1999. Applicants also claim priority under 35 U.S.C. §365 of PCT/AT00/00095, filed on Apr. 18, 2000. The international Application under PCT article 21(2) was not published in English.

BACKGROUND OF THE INVENTION

1. Field of the Invention

The invention relates to a device for equalizing relative displacements in level between ground areas and frame-provided closing means of installations, e.g. shafts or slide rod assemblies with protective shells, comprising a load transmission element connected to the closing means frame.

With installations in traffic area bodies or, generally, in the ground, such as, e.g., with gully holes, water supply, gas or telephone shafts, or also with slide rod assemblies including protective shells, the uppermost closing element parts, i.e. the shaft lid or road caps, e.g., will be raised or lowered relative to the traffic area upper side. This, i.a., is due to the fact that a gully hole, e.g., is located at a level substantially below the conventional frost line. Thus, the shaft bottom will not be affected by the influences of frost or thawing, respectively, which cause swellings or shrinkages, respectively. Such swellings or shrinkages, however, do occur in traffic area bodies, e.g. road bodies. As a consequence, a relative difference in level between the road surface or, generally, the upper face of the traffic area and the shaft system will be found, causing bouncing to vehicles rolling thereover, and possibly even causing damage to the vehicles themselves. Moreover, as a consequence of such irregularities in level, a damage to the closing means proper, the lids or the like, may occur, possibly even leading to the destruction thereof and necessitating complicated repair work. Another possible reason for such relative movements of level are, e.g. settling events in the soil.

Movements in level may also occur in ground regions on private property, possibly also in planted areas, yet in most instances traffic areas, i.e. roads, parking spaces etc. are affected.

The said relative shifts in level or dilations are primarily caused in the region of the so-called frost road bed construction of road bodies, with gully lids, e.g., lying at a lower level relative to the road surface in winter, whereas they protrude from the road surface in summer.

2. Description of the Prior Art

In CA 1,289,799 C, a device as initially defined has been proposed, in which a floating support of a shaft cover is sought so as to attain a vertical movability thereof. In detail, the shaft cover is put on a tube part which externally telescopically overlaps the shaft. On the jacket face of this tube part, annular grooves or ribs are provided for an improved non-positive engagement with the surrounding road body. This tube part thus is conceptioned as a load transmission element to entrain the shaft cover in upward direction during a shift in the level of the road body. In fact, however, this known construction is not suitable for such a dilatation equalization because in possible movements in the road body, the material of the road body will tear off in layers. Apart from this, as a rule, the substructure material in the immediate vicinity of a shaft will not freeze even at freezing temperatures—and thus there will not be any substantial movement of level since the shaft will raise the temperature. in this immediate shaft area.

Besides, also shaft constructions are known in which, when traffic areas are provided, an upper telescope-like shaft part is to enable an adjustment of the shaft height to the surrounding traffic area level, this telescope part being tightly anchored when it is installed, for which purpose, e.g., a site-mixed concrete layer is provided around the telescope part, cf. in particular AT 403,42 B, but also U.S. Pat. No. 4,936,703 A or U.S. Pat. No. 5,044,818 A. A dilatation equalization is not sought with these known installations, and it is not possible, either.

SUMMARY OF THE INVENTION

It is now an object of the invention to provide an efficient device for equalizing relative vertical movements between closing means and ground areas, and, for this purpose, to de-couple the rigid shaft or, generally, the rigid installation from the closing means construction. The structure of the device is to be as simple as possible and is to allow for a mounting thereof without any problems.

The inventive device of the initially defined type is characterized in that the load transmission element is formed by a plate-shaped dragging body which supports the closing means frame and which projects horizontally into the ground structure so as to transfer the changes in level occurring there to the closing means frame.

In the present device, thus, a load-transmitting plate-shaped dragging body is provided which projects into the road body or, generally, into the traffic area structure and thus participates in its movements. The plate-shaped dragging body may, e.g., be immediately applied to the upper rim of the frost road bed construction of a road body. The plate-shaped dragging body thus sharing the movements of the traffic area thus will entrain the closing means frame, i.e., e.g., the gully lid frame during upward and downward movements caused by the weather so that the lid will remain at the level of the ground upper side, commonly an asphalt or concrete wear layer of a traffic area. In the plate-shaped dragging body also forces transmitted from the closing means frame are conducted, and insofar this plate body can also be termed load transfer or load equalization body. This plate-shaped load equalization or dragging body may have different shapes and sizes, depending on its application, and may be produced from various materials, such as, e.g., from a composite material. For reasons of weight, steel will rather be used for smaller sizes, and the plate-shaped dragging body may, e.g. have external dimensions in the order of 1.5 m to 2.5 m in a dilatation equalizing device for gully holes. Preferably, a synthetic material is used for the plate-shaped dragging body, such as, in particular, a glass fiber reinforced UP resin (UP-unsaturated polyester resin), yet optionally also polyvinyl chloride (PVC), polypropylene (PP), polyethylene (PE) or recycling material mixtures PE/PP. With such a synthetic material, moreover, the advantage is gained that when hot bitumen is applied as a wear layer to the traffic area, the plate-shaped dragging body will be heated by the heat of the hot bitumen and thus will be softened, thereby being enabled to adapt to local uneven portions of the fine soil; this adaptation will, moreover, be additionally enhanced by the pressure exerted during the application of the hot bitumen and the consolidation rolling thereof. This ensures later on, when the traffic area including the shaft installation has been finished, a particularly effective force or pressure uptake on the plate-shaped dragging body, so that when the road construction material moves, the closing means construction can be entrained by the plate-shaped dragging body practically without play.

In the case of a dilatation equalization for road caps in slide rod assemblies including a protective shell it may suffice for the plate-shaped dragging body supporting the road cap frame to be simply vertically moved relative to a slide rod assembly protective shell, if the pavement of the traffic area carries out the said movements in level. However, if these installations are gully holes or the like, it will be desired as a rule to lead the shaft as far as to the upper side of the traffic area, and this must be so in a variable manner. Accordingly, it is particularly advantageous if at least one telescope part extends from the plate-shaped dragging body downwards to the respective installation. The rigid installation (shaft) thus will end here at a relatively deep level, e.g. at the level of the lower side of the frost road bed construction of the road body, and the telescope part will form an adaptable extension of this installation, in particular shaft, in upward direction. In doing so, the telescope part must also be entrained by the plate-shaped dragging body at the movements of the latter, and insofar it is advantageous if the telescope part is non-positively connected with the plate-shaped dragging body. The non-positive connection may, in particular, be provided by welding, gluing, screwing or the like.

Moreover, it is suitable if the telescope part with its lower portion slidingly engages with the outer side of a stationary body connected with the installation. The stationary body forms an extension of the shaft or, generally, of the installation, and it serves as a guide shell or, generally, guide part for the telescope part at the upward and downward movements of the latter. It is possible to provide sealing means at the border face between the telescope part and the stationary body. Moreover, it is advantageous if the stationary body is non-positively connected with the installation via an equalizing fastening element. This equalizing fastening element ensures the non-positive connection of the stationary body with the installation, a certain equalization in terms of different levels and, optionally, inclined positions being possible.

With appropriately long telescope parts it may also suffice if the telescope part with its lower portion slidingly abuts on the inner side of a guide body connected with the installation. The guide body may then e.g. be of annular shape and provided at the upper side of the installation, e.g. shaft, and on its inner side it may again be provided with a sealing means so as to provide for a tight sealing relative to the telescope part sliding thereon. Here, too, it is again advantageous if for the purpose of a positive connection with an equalization being allowed, the guide body is connected with the installation via an equalizing fastening element.

If larger heights are to be bridged, advantageously also an embodiment may be provided in which two telescope parts are arranged one above the other, the upper one of which being connected with the plate-shaped dragging body, and the lower one slidingly engaging a guide body connected with the installation. The two telescope parts may in turn contact each other with a sealing means interposed and may slide relative to each other.

In case of difficult substructure conditions, it may advantageously be provided that the telescope part slidingly abuts on an upper stationary body part connected with an e.g. bellows-type or corrugated deformation element. Suitably, the deformation element will be integrated in a stationary element, and in this way it can accommodate setting events. Advantageously, the deformation element is protected towards the outside by being externally surrounded by a protective shell. In this manner, a road substructure, in particular the frost road bed construction, cannot adversely affect the deformation element.

To provide for a possible greater equalization of level (in terms of height or slope) between the plate-shaped dragging body and the telescope part, it is also suitable if the telescope part is connected with the plate-shaped dragging body via an element for level equalization. A non-positive connection may be provided between the plate-shaped dragging body and the element for level equalization, on the one hand, and between the element for level equalization and the telescope part, on the other hand.

Likewise, it is also advantageous if the closing means frame is supported on the plate-shaped dragging body via an element for level equalization. Here, too, advantageously there is a non-positive connection of the element for level equalization towards either side, i.e. to the dragging body on the one hand, and to the closing means frame, on the other hand.

As a rule, however, it suffices for achieving the final level and for non-positively leading away the forces from the closing means frame towards the dragging body, if the closing means frame is connected with the plate-shaped dragging body via an equalization fastening element. This may be a gluing mass, cement mass, bitumen mass or the like, yet also screw connections are possible.

To prevent horizontal shiftings and to allow for a type of centering action, it is also advantageous if the plate-shaped dragging body has an abutment web located externally of the closing means frame.

Depending on the type of application, the most varying shapes are conceivable for the dragging body, such as rectangular, square or oval plates. Yet, advantageously, the dragging body is formed as an annular plate, and, moreover, it is provided with radially extending stiffening ribs for reinforcing purposes.

A subject of the invention is also an auxiliary device for mounting a device as indicated above, by means of which it is possible to protect in a simple manner those parts of the device, such as particularly the telescope part, as well as furthermore the interior of the installation, e.g. shaft, which have to be mounted already during the construction of a road body or, generally, a ground structure.

According to the invention, this auxiliary device is characterized by spacers for attaching the telescope part at a given distance above the installation or the stationary body connected therewith, and by a cover capable of being put onto the spacers. By the spacers, the telescope part will be maintained in the correct position, while the bottoming or the frost road bed construction, respectively, of the traffic area body is applied externally therearound, and the cover will prevent the bulk material, such as pebble stones, sand etc., from dropping into the interior of the respective installation, such as, e.g., a gully hole.

The spacers are several discrete spacer elements, which are e.g. inserted at regular intervals around the periphery of the stationary body already mounted on the installation as well as below the telescope part. A good level adjustment is possible, and, if necessary, also inclined positions are possible in case of an inclined ground, if the spacers are designed with different heights.

With a view to a simple position fixing and an additional sealing, it is, moreover suitable if the cover has an engagement part projecting into the telescopic part. For sealing purposes it is, moreover, advantageous if the cover is designed with a sealing means which, in the mounted state, will be present in the gap between the cover and the telescope part, or if a fixing part of the spacers projects into the gap.

In the following, the invention will be explained in more detail by way of preferred exemplary embodiments illustrated in the drawings to which, however, it shall not be restricted. In detail, in the drawings,

DETAILED DESCRIPTION OF THE PREFERRED EMBODIMENTS

Figure 1:
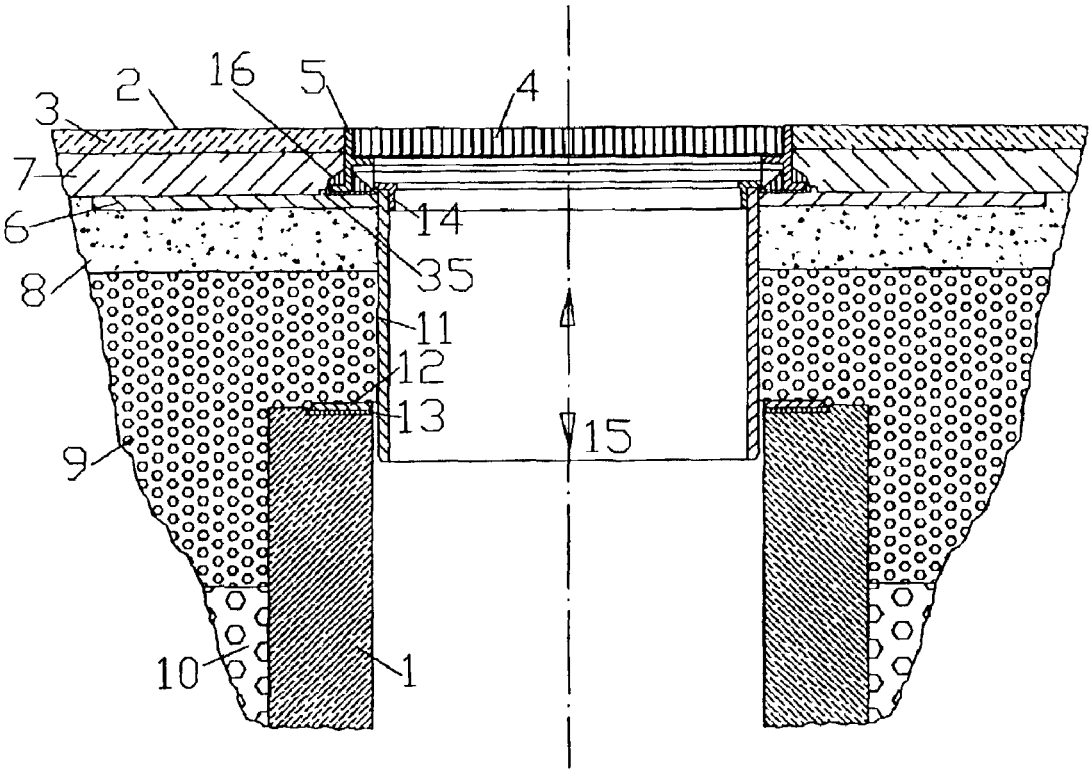
FIG. 1 shows a schematic vertical section through a gully hole comprising an equalizing device.

FIG. 1, e.g. an installation in a road body in the form of a gully hole 1 is shown which ends below the upper side 2 of a road surface or traffic area (generally, a ground surface). At the level of the upper side 2 of the traffic area, or actually, a wear layer 3 of the latter, according to FIG. 1 there is a closing means for the installation 1, i.e. a gully lid 4 within a lid-frame or ring 5. The frame 5 is supported on a plate-like dragging body 6 projecting into the road body below a carrying layer 7 of the latter and above a fine plane 8 over a frost road bed construction 9. Below the frost road bed construction 9, a bottoming 10 is provided in the road body, extending upwardly substantially as far as to the upper side of the installation 1, i.e. the hole or shaft.

At its inner periphery, the plate-shaped dragging body 6 (termed dragging plate 6 in short hereinafter) is non-positively connected with a telescope part 11 which, in the exemplary embodiment illustrated, substantially is formed by a simple pipe. With its lower portion, this telescope part 11 projects into the upper part of the shaft 1, engaging the inner side of an, e.g., annular guide body 12 and thus being guided in its upward and downward movements to be explained in more detail further below. For sealing purposes, a gasket 13 may be provided below the guide body 12, between the upper rim of the shaft 1 and the telescope part 11. In particular, it is also conceivable to combine the guide body 12 with the gasket 13 in one structural element, possibly even in a single part made of synthetic material.

On the upper side of the tubular or annular telescope part 11, a protection ring may be provided as shown at 14 in FIG. 1.

When mounting has been effected in the manner shown in FIG. 1, level movements of the upper layers of the road body, particularly caused by expansions or contractions of the frost road bed construction 9, are shared by the dragging plate 6, and this dragging plate 6 on the one hand entrains the frame 5 of the closing means, the gully lid 4 in this instance, and on the other hand also the telescope part 11 is entrained by the dragging plate 6 in these vertical movements, as indicated by the double arrow 15 in FIG. 1. In this manner it is always ensured, on the one hand, that the interior of the shaft in the upper region thereof is protected by a sheath, i.e. the telescope part 11, and, on the other hand, and this is important, it is ensured in this manner that the frame 5 including the lid 4 will always be present at the level of the upper surface 2 of the traffic area so that there will be no differences in level between the parts 4, 5 of the closing means and the surface 2, even if the surface 2 rises in winter and descends in summer.

In the further drawing FIGS. 2 to 11, corresponding structural elements have the same reference numbers as in FIG. 1, and insofar as there is coincidence with the assembly according to FIG. 1, the description will not be repeated.

Figure 2:
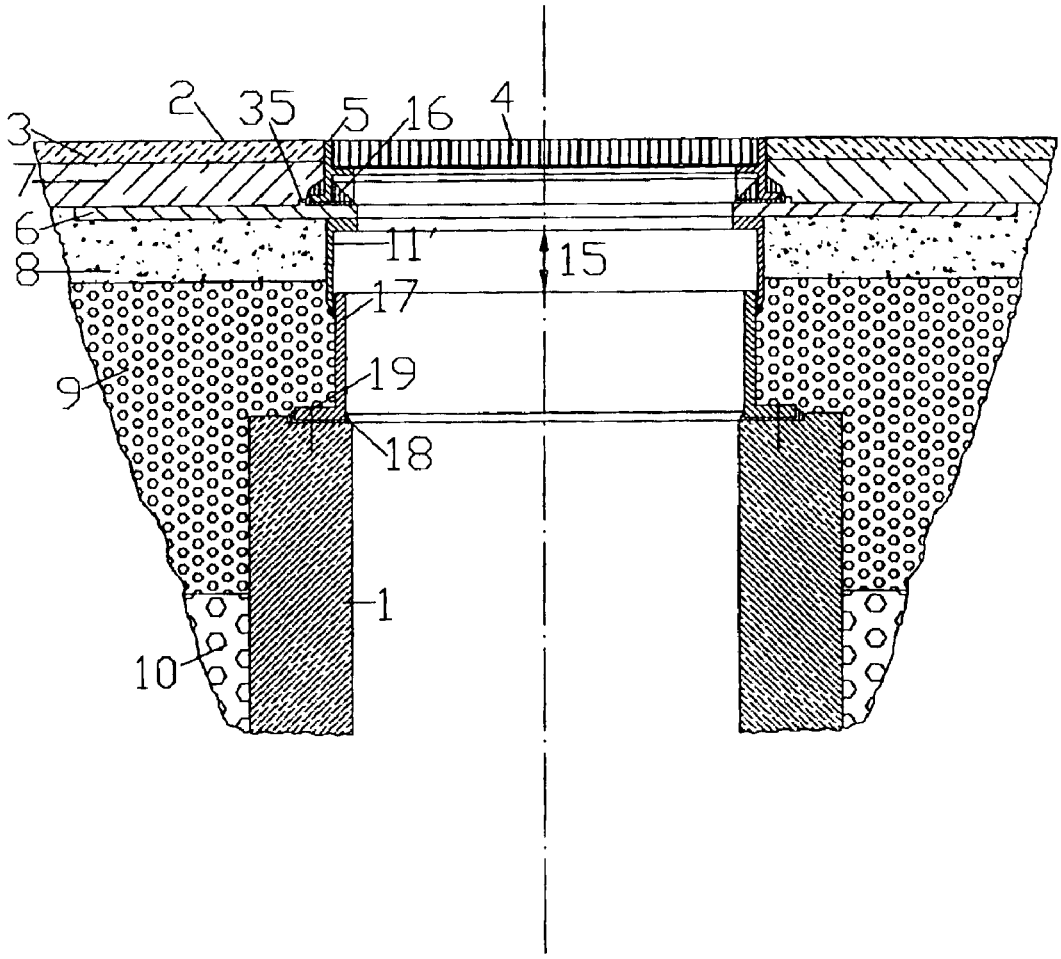
FIG. 2 shows a slightly modified equalizing device provided above a gully hole, also in a schematic vertical section.

In the preferred exemplary embodiment of FIG. 2 which, at present, is considered particularly advantageous, just as in that of FIG. 1, the frame 5 is connected with the dragging plate 6 via an equalizing fastening element 16, e.g. a gluing, cement or bitumen mass etc., so that the dragging plate 6 will forcedly entrain the frame 5 not only during upward movements, but also during downward movements. According to FIG. 2, the dragging plate 6 at its lower side adjacent its inner rim carries a telescope part 11, positively connected thereto and of a configuration slightly modified relative to that of FIG. 1, engaging with its lower portion, which is inwardly directed under an oblique angle, the outer side of a stationary body 17 which in turn is connected with the upper side of the shaft or, generally, of the installation 1 via an equalizing fastening element 18, e.g. a gluing or cement mass etc.. The stationary body 17 has e.g. an annular shape with an L-cross-section and may, moreover, be fixed on the shaft 1 by means of bolts, as schematically indicated at 19 in FIG. 2. Preferably, the stationary body is made of synthetic material, in particular of recycling material, e.g. mixtures of polyethylene and polypropylene; yet also other materials such as PVC or also glass fiber-reinforced UP resin may be used.

As has already been mentioned, for the dragging plate, on the other hand, preferably a synthetic material softening by the application of heat is used, such as, in particular, a glass fiber-reinforced synthetic material, in particular a glass fiber-reinforced UP resin; as further synthetic materials, PVC, PP, PE or recycling material mixtures PE/PP may be used here. In smaller embodiments, also steel may be employed.

It should be mentioned that besides circular, the contour of the installations may, of course, also be a different one, e.g. square, rectangular, oval etc., and suitably the shape of the dragging plate 6 will be chosen so as to fit thereto.

Figure 3:
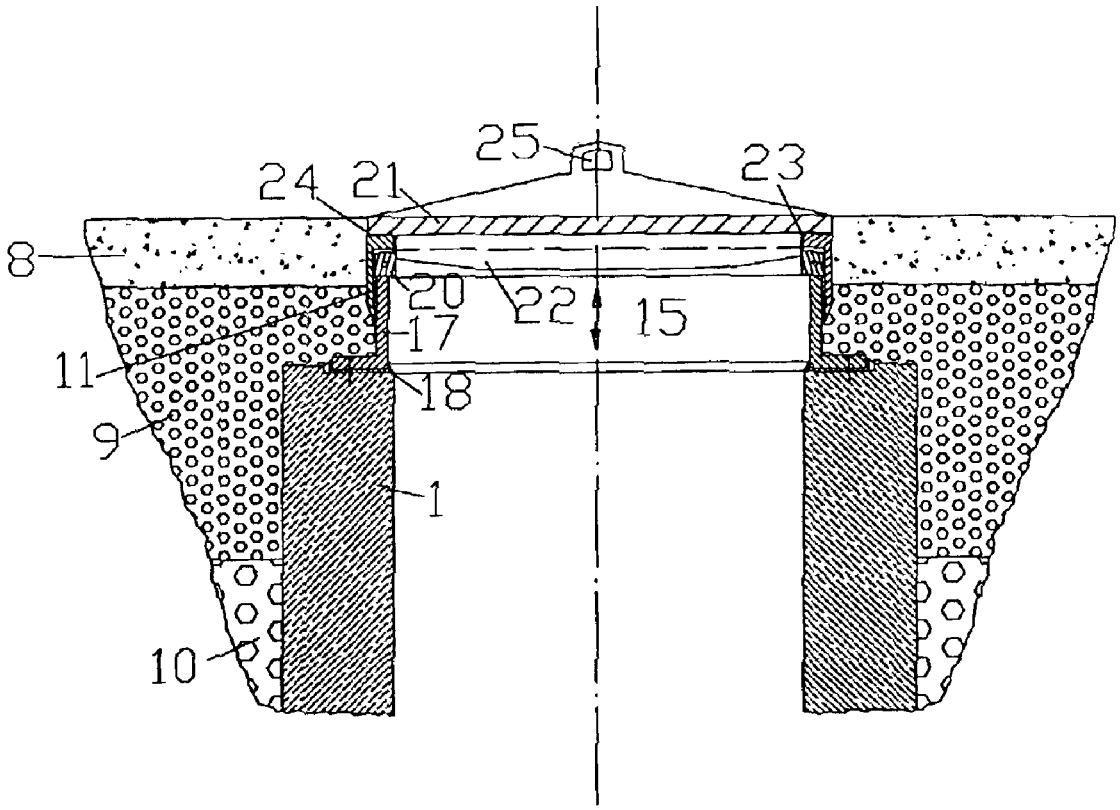
FIG. 3 shows a portion of this device of FIG. 2 in combination with an auxiliary device to illustrate mounting while the traffic area is built.

In FIG. 3, an intermediate step during mounting of the device according to FIG. 2 or during the making of the road body is schematically shown, the bottoming 10, the frost road bed construction 9, and the fine soil 8 of the road body already being provided; the latter layers are applied with the auxiliary device already mounted. In detail, prior to the application of the frost road bed construction 9 and the fine soil 8, the stationary body 17 is applied to the upper side of the shaft 1, and the telescope part 11' is laid onto this— annular—stationary body 17, with spacers 10 interposed. In this manner, the telescope part 11' will have the desired height with its upper side so that subsequently, after application of the fine soil 8, the dragging plate 6 (cf. FIG. 2) not yet visible in FIG. 3 can be applied.

To prevent construction material from entering the interior of shaft 1 during the production of the road body layers, the shaft is closed at the upper side of the telescope part 11' by aid of a cover 21. The cover 21 is substantially plate-shaped, yet at its lower side it has an engagement part 22 projecting into the interior of the telescope part 11' so as to fix its position; the sealing effect may be increased by providing a sealing means 23 in the corner region where the engagement part 22 engages, which sealing means is provided in the gap between the telescope part 11', or more precisely, its upper, inwardly directed annular flange 24, and the outer periphery of the engagement body 22. In the embodiment according to FIG. 3, on the upper side, the cover 21 is provided with a traction eye 25 or with one or several handles, respectively.

Figure 4:
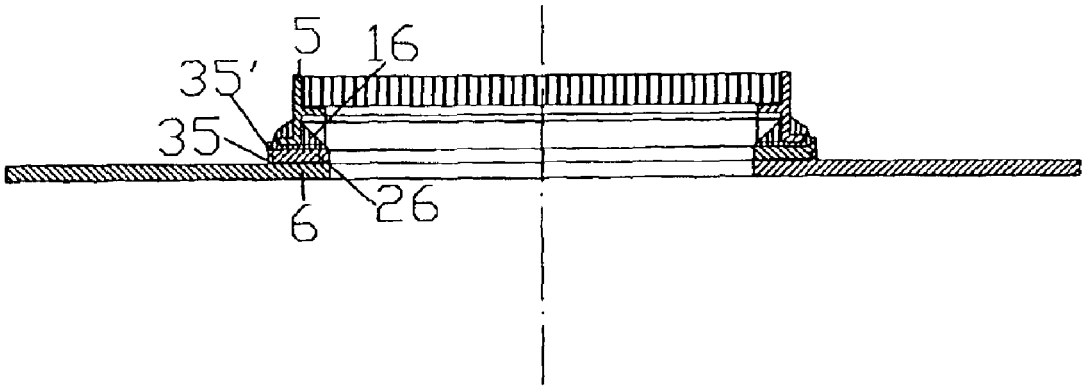
FIGS. 4 and 5 show parts of the device according to FIG. 2, with additional level equalizing elements being illustrated.

In FIG. 4, the upper region of the device according to FIG. 2 is illustrated in a somewhat modified form, an element 26 for level equaling being arranged between the frame 5 and the dragging plate 6. Thereabove, the afore-mentioned equalization fastening element 16 is arranged so as to provide for a positive connection with the frame 5. Of course, also the element 26 for level equalization is positively connected with the dragging plate 6 by cementing, welding, gluing or screwing etc. With the element 26 for level equalization, any larger differences in level may comfortably be equalized.

Figure 5:
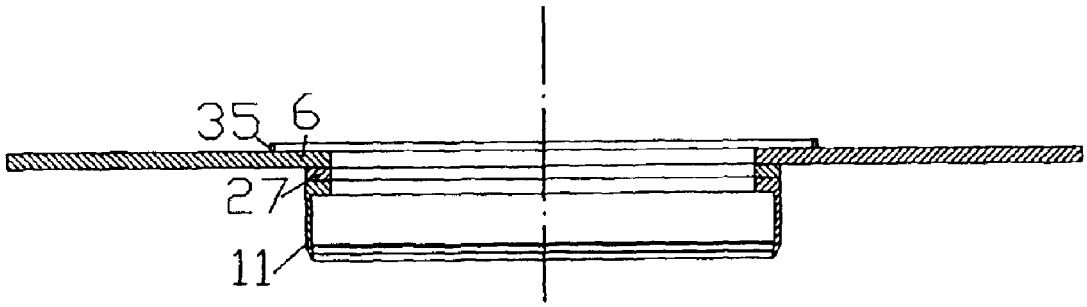

Similar aspects apply to the element 27 for level equalization shown in FIG. 5 at the lower side of the dragging plate 6, via which the connection to the telescope part, e.g. 11', is made.

Figure 6:
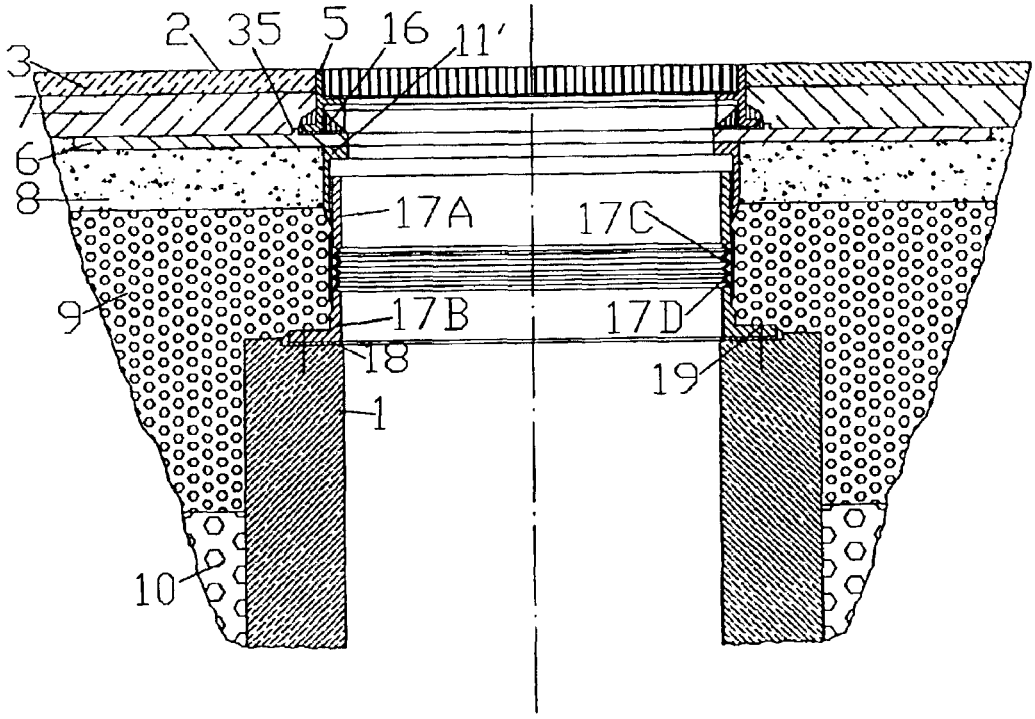
FIGS. 6 to 8 show three further embodiments of the present device in illustrations similar to FIG. 2, in combination with gully holes.

The embodiment according to FIG. 6 is different from that of FIG. 2 insofar as a stationary body 17 suitable for difficult substructure conditions is provided which is designed in more than one part, having an upper stationary body part 17A and a lower stationary body part 17B, with an e.g. bellows-type or corrugated deformation element 17C being interposed. On its outer side, this deformation element 17C is protected by a protective shell 17D relative to the road structure. The telescope part 11' is displaceable along the outer side of the upper stationary body part 17A, and it is connected with a dragging plate 6 in an arrangement as previously explained by way of FIG. 2, the dragging plate 6 furthermore carrying the frame 5 of the closing means on its upper side.

Figure 7:
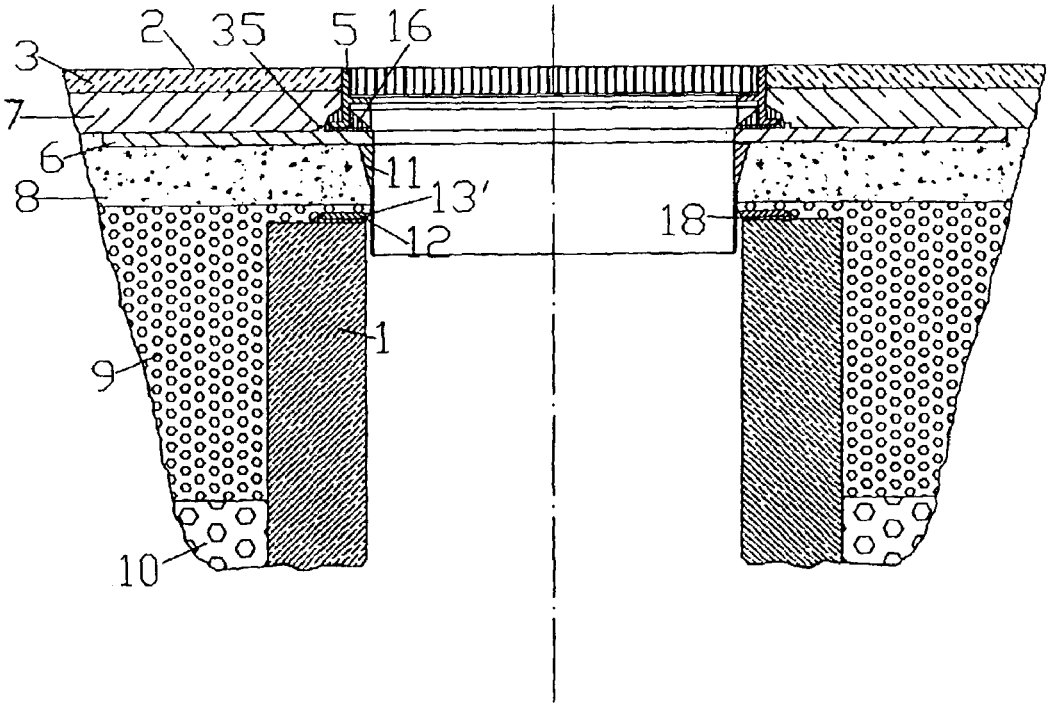

In FIG. 7, a device largely similar to that of FIG. 1 as regards the telescope part 11 is shown, this telescope part 11 being present within a guide body 12 and projecting into the shaft 1. The guide body 12 is connected with the shaft 1 via an equalizing fastening element 18 as explained by way of FIG. 2, and it may comprise a sealing lip 13' at its inner periphery so as to provide for sealing relative to the outer side of the telescope part 11.

Figure 8:
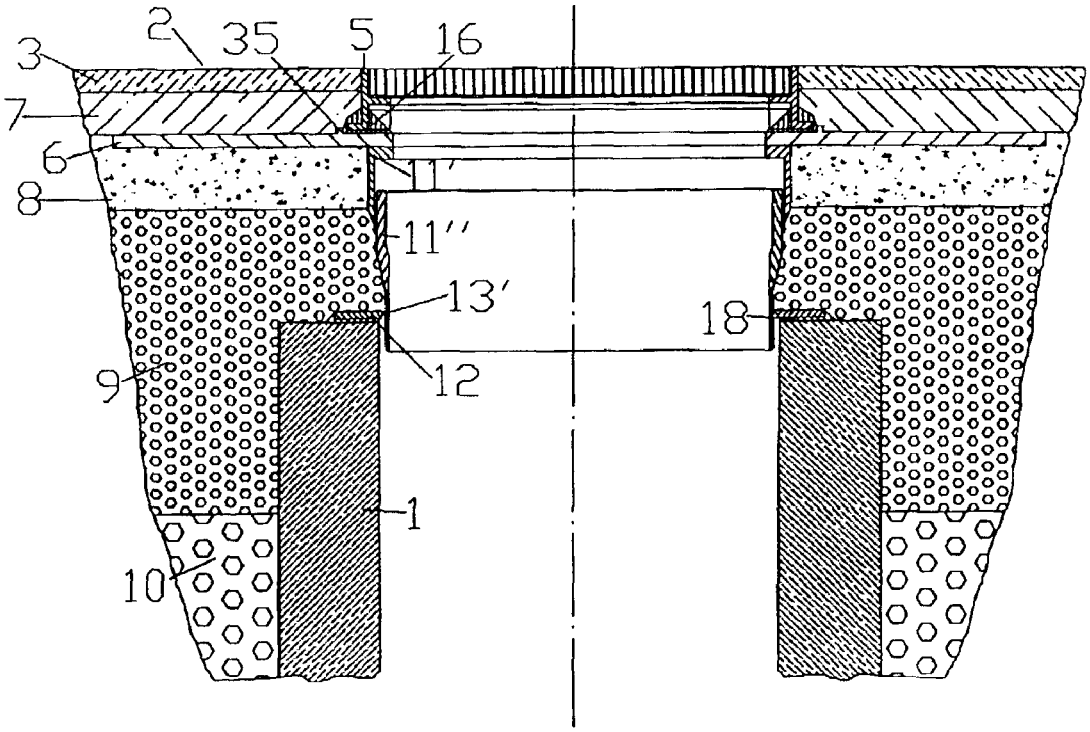

The embodiment according to FIG. 8 is suitable for high road constructions, if large heights.have to be bridged from the deep-lying shaft 1 to the road upper surface Accordingly, two nested telescope parts 11', 11" are provided, wherein the upper telescope part 11'which is non-positively connected with the dragging plate 6 corresponds to the telescope part 11' according to FIG. 2. However, it slides in a lower, inner telescope part 11" which projects into the interior of shaft 1 similar to the inner telescope part 11 previously explained (cf. FIG. 1 and particularly FIG. 7). The inner telescope part 11' may be movably connected with the upper telescope part 11 just as with the guide body 12 (which may be designed similar to that of FIG. 7).

Figure 9:
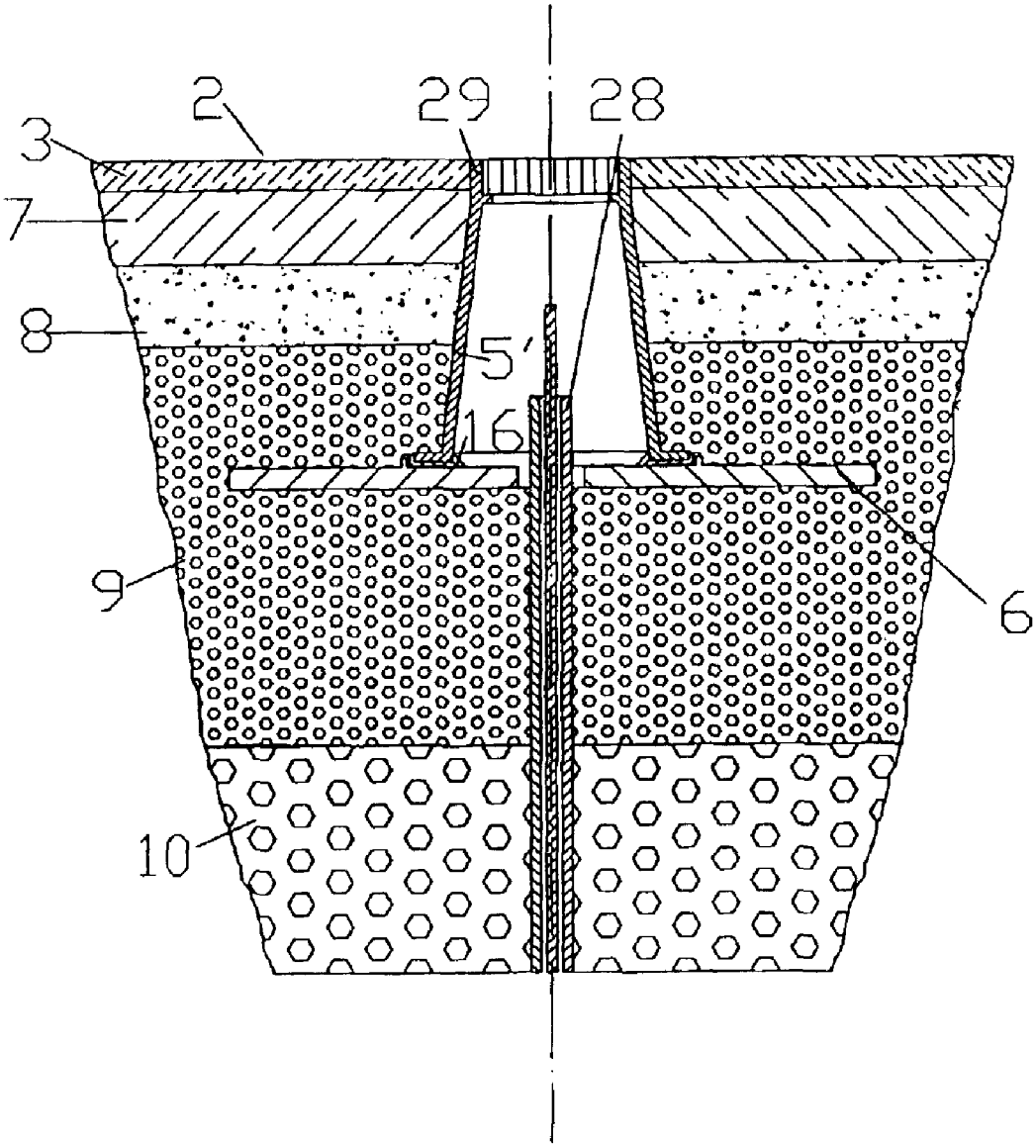
FIGS. 9 and 10 show two embodiments of the device in combination with slide bar assemblies.
Figure 10:
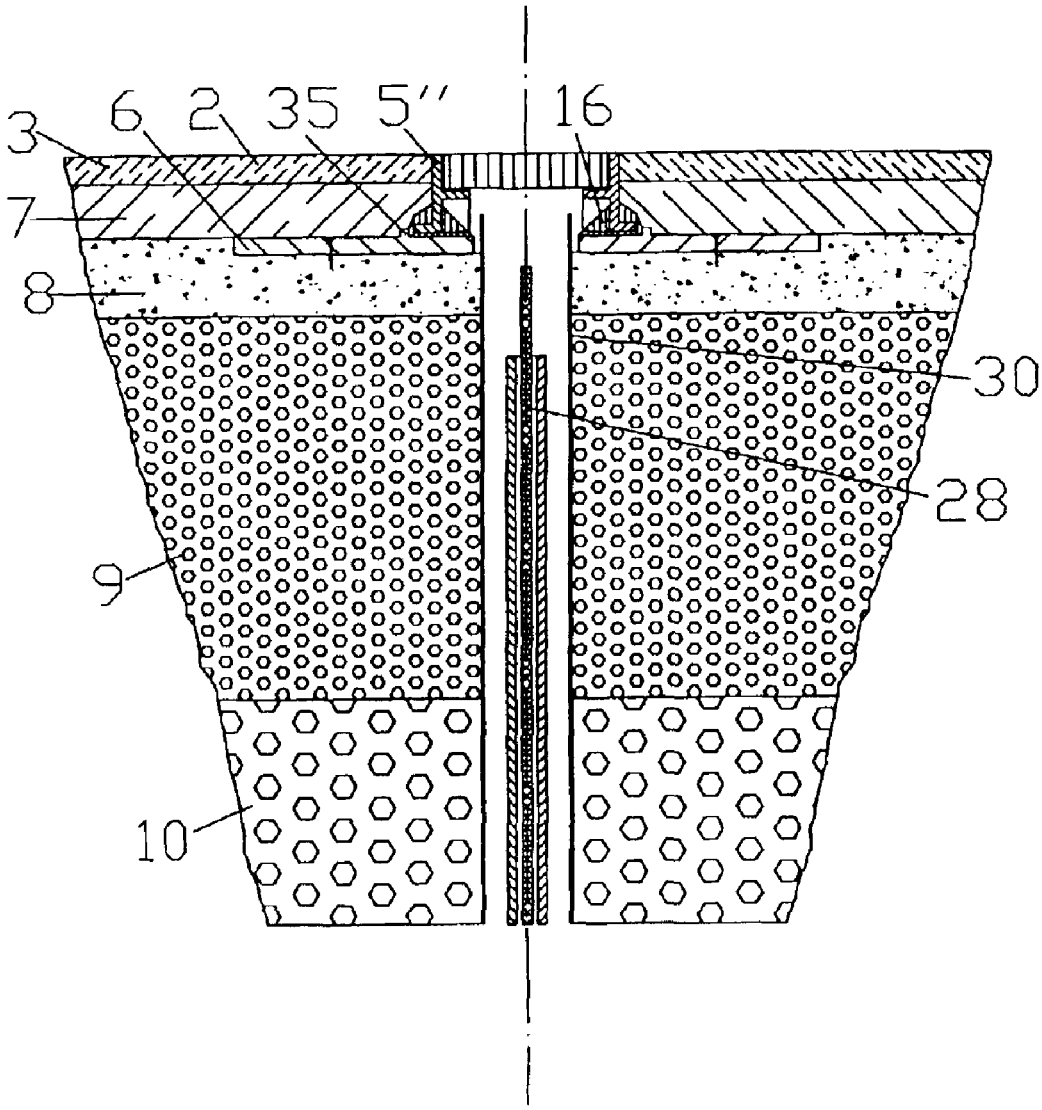

In FIGS. 9 and 10, two embodiments of the present device are illustrated in connection with road cap closing means as they are used e.g. with slide rod assemblies.

In detail, in FIG. 9, a conventional slide rod assembly including a protective shell at 28 is shown on which a conventional road cap frame serving as closing means frame 5' is supported. In detail, again non-positive connection is provided via an equalizing fastening element 16. (The road cap to be attached on the frame 5' over the inner collar 29 thereof has been omitted in FIG. 9 just as in FIG. 10 for reasons of simplicity.)

In FIG. 10 an embodiment modified relative to that of FIG. 9 is illustrated in which a changed road cap frame 5" of lower construction height is provided instead of the conventional road cap frame 5'. With this road cap frame 5" it is made possible to get the dragging plate 6 again to the level of the fine soil, as illustrated in FIGS. 1 and 2. Yet, the conventional slide rod assembly with its protective shell, as shown at 28, must be surrounded by a separate protective shell 30 bridging the difference in level.

In the embodiments according to FIGS. 9 and 10, any conventional rod assembly with a protective shell for the actuation of slides of any type may be provided, and also here the dragging plate 6 carries out its function, i.e. in case of vertical movements in the traffic area construction, to participate in these movements and thus to entrain the respective closing means frame 5' or 5", respectively, so that the lid will be maintained at the level of the surface of the traffic area construction even if the latter undergoes movements of level.

Figure 11:
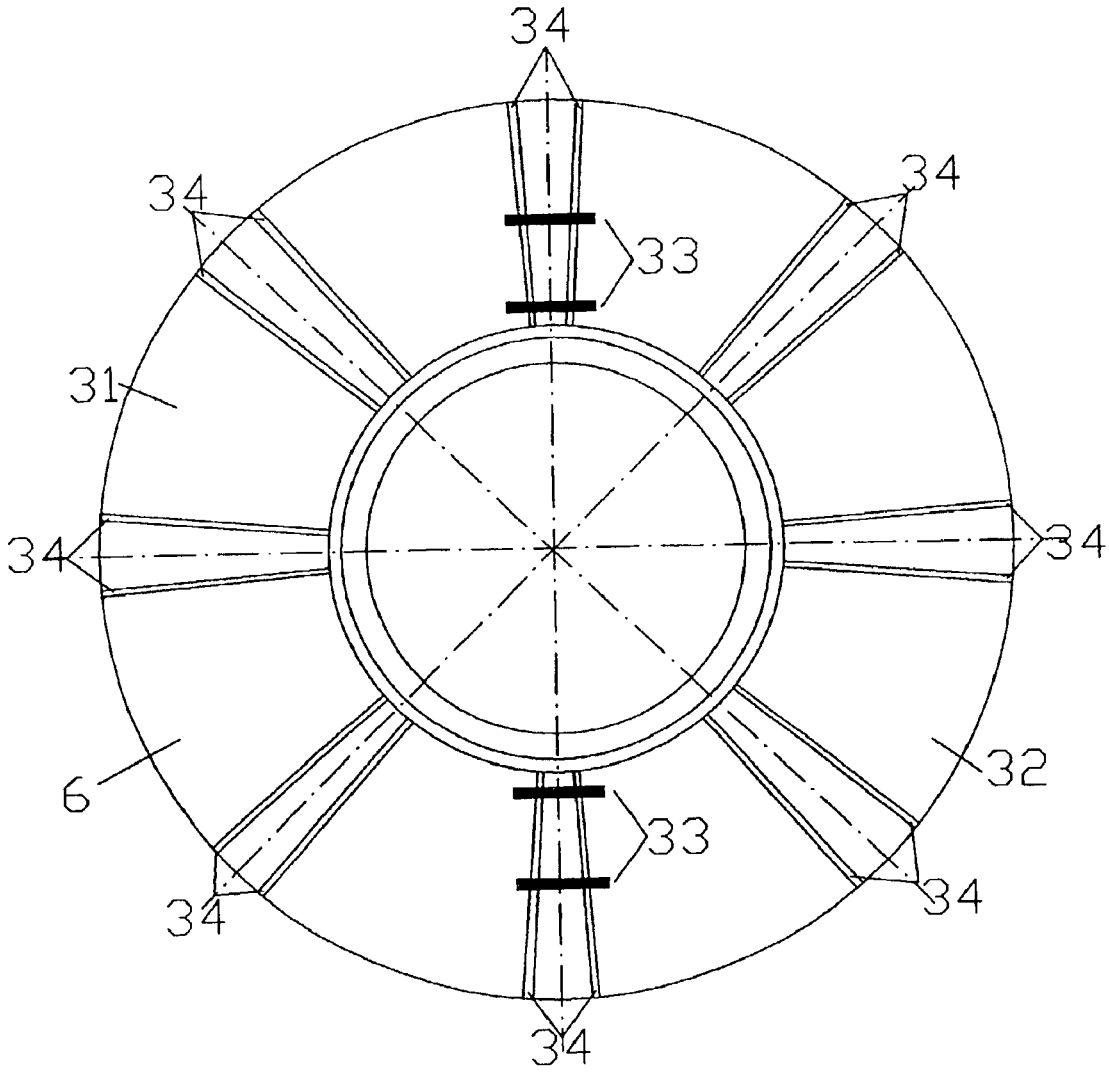
FIG. 11 shows a schematic top view onto a dragging body in the form of a ring plate.

In FIG. 11, finally, a top view onto a multi-part dragging plate having e.g. the form of an annular plate is shown as an alternative to a one-part dragging plate, wherein the dragging plate 6 in this instance comprises two ring halves 31, 32 (it could, however, also consist of more than two parts, yet it could, of course, also consist of just one part); the ring halves 31, 32 are interconnected by closures 33. The dragging plate 6 may, moreover, be provided with e.g. radially extending stiffening ribs, as indicated at 34.

From FIGS. 1, 2, 5 to 10 it may, moreover, be seen that the dragging plate 6 may be designed with an abutment web 35 which facilitates attachment of the respective frame 5, or 5', or 5", respectively and, in particular, forms a limit for the equalizing fastening element 16. A corresponding abutment web 35' may be provided in the embodiment according to FIG. 4 when the element 26 for level equalization is provided, at the upper side of the latter.

What is claimed is:

1. An equalizing assembly for equalizing changes in level below a ground area surface extending over a ground structure and a frame for closing means of an installation projecting into a ground structure therebelow, the frame having an interior chamber covered by the closing means, comprising a plate-shaped dragging body connected to the closing means frame and projecting horizontally into the ground structure below said ground area surface, between a carrying layer thereof and a frost road bed of the ground structure so as to transfer the changes in level to the closing means frame, the plate-shaped dragging body being a separate structural element which supports the closing means frame on an upper side thereof, and the plate-shaped dragging body having a hole leading from the interior chamber of the frame to the installation.

2. An equalizing assembly according to claim 1, wherein at least one telescope part variably extending the installation in upward direction extends from the plate-shaped dragging body downwards into the installation.

3. An equalizing assembly according to claim 2, wherein the telescope part is frictionally connected to the plate-shaped dragging body.

4. An equalizing assembly according to claim 2, wherein the telescope part has a lower portion slidingly engaging an outer side of a stationary body connected to the installation.

5. An equalizing assembly according to claim 4, wherein the stationary body is frictionally connected to the installation by an equalization fastening element.

6. An equalizing assembly according to claim 2, wherein the telescope part has a lower portion slidingly engaging an inner side of a guide body connected to the installation.

7. An equalizing assembly according to claim 6, wherein the guide body is connected to the installation by an equalizing fastening element.

8. An equalizing assembly according to claim 2, wherein the telescope part has two portions arranged one above the other, an upper one of which is connected to the plate-shaped dragging body, and a lower one slidingly engages said guide body connected to the installation.

9. An equalizing assembly according to claim 2, wherein the telescope part slidingly engages an upper stationary body part connected to a bellows-type or corrugated deformation element.

10. An equalizing assembly according to claim 9, wherein the deformation element is externally surrounded by a protective shell.

11. An equalizing assembly according to claim 2, wherein the telescope part is connected to the plate-shaped dragging body by an element for level equalization.

12. An equalizing assembly according to claim 2, wherein the closing means frame is supported on the plate-shaped dragging body by an element for level equalization.

13. An equalizing assembly according to claim 1, wherein the closing means frame is connected to the plate-shaped dragging body by an equalizing fastening element.

14. An equalizing assembly according to claim 1, wherein the plate-shaped dragging body has an abutment web located externally of the closing means frame.

15. An equalizing assembly according to claim 1, wherein the dragging body is an annular plate.

16. An equalizing assembly according to claim 1, wherein the plate-shaped dragging body is provided with radially extending stiffening ribs.

17. A method for mounting a device for equalizing changes in level between a ground area surface extending over a ground structure and a frame for closing means of an installation projecting into a ground structure therebelow, the frame having an interior chamber covered by the closing means, comprising a plate-shaped dragging body connected to the closing means frame and projecting horizontally into the ground structure between a carrying layer thereof and a frost road bed of the ground structure so as to transfer the changes in level to the closing means frame, the plate-shaped dragging body being a separate structural element which supports the closing means frame on an upper side thereof, and the plate-shared dragging body having a hole leading from the interior chamber of the frame to the installation, which comprises the steps of (a) placing a spacer on the installation or a stationary body connected thereto before the ground structure is completed by applying the carrying layer, (b) placing a telescope part over the spacer, (c) covering the telescope part, and completing and compacting the ground structure below the carrying layer, (d) thereafter uncovering the telescope part, and placing the plate-shaped dragging body over the telescope part, and (e) then applying the carrying layer over the plate-shaped dragging body.

18. The mounting method of claim 17, wherein the telescope part is covered by engaging the telescope part with a cover.

19. The mounting method of claim 18, wherein the cover is sealed to the telescope part.

* * * * *